United States Patent [19]

Pfeffer

[11] Patent Number: 4,846,445

[45] Date of Patent: Jul. 11, 1989

[54] HYDRAULIC FENCE POST PULLER

[76] Inventor: Wilford W. Pfeffer, 741 FM 1456, Bellville, Tex. 77418

[21] Appl. No.: 34,687

[22] Filed: Apr. 6, 1987

Related U.S. Application Data

[63] Continuation of Ser. No. 650,171, Sep. 13, 1984, abandoned.

[51] Int. Cl.[4] ..... B66F 1/02

[52] U.S. Cl. ..... 254/30; 254/132

[58] Field of Search ..... 254/29 R, 30, 31, 124, 254/132, 106; 37/2 R; 144/34 R

[56] References Cited

U.S. PATENT DOCUMENTS

| | | | |
|---|---|---|---|
| 2,244,899 | 6/1941 | Smith | 254/29 R |
| 2,440,180 | 4/1946 | MacClatchie | 37/2 R |
| 2,681,789 | 6/1954 | Nichols | 254/29 R |
| 2,790,210 | 4/1956 | Hamborg | 254/132 |
| 2,803,431 | 8/1957 | Cooper | 254/132 |
| 2,888,245 | 5/1959 | Anderson | 254/29 R |
| 3,183,949 | 5/1965 | Larsen | 144/34 R |
| 3,208,726 | 9/1965 | Dowell | 254/132 |

FOREIGN PATENT DOCUMENTS

| | | | |
|---|---|---|---|
| 353168 | 10/1937 | Italy | 254/30 |

*Primary Examiner*—Robert C. Watson

*Attorney, Agent, or Firm*—Bernard A. Reiter; Mark G. Bocchetti

[57] ABSTRACT

Disclosed is an apparatus for extracting the fence post and the like from the earth. The invention is preferably used in conjunction with a tractor, backhoe or other piece of mobile equipment having hydraulical controls for supplementally attached equipment. The hydraulic controls of the tractor are connected to a hydraulic cylinder on the apparatus capable of creating approximately one foot of horizontal travel within the apparatus. Through the use of a fixed length of cable and a series of sheaves, this approximate one foot of horizontal travel is translated into approximately five feet of vertical travel. There are self-clamping jaws which automatically engage a fence post or the like when the hydraulic cylinder is used to actuate the lifting mechanism. In operation, the tractor is merely backed up to a fence post and the hydraulic controls operated to actuate the hydraulic cylinder thereby engaging the fence post and extracting it all in one motion. The fence post is then released by reversing the hydraulic controls. The tractor may then be driven to the next fence post for extraction.

8 Claims, 2 Drawing Sheets

HYDRAULIC FENCE POST PULLER

This is a continuation of Application Ser. No. 06/650,171, filed 9/13/84, now abandoned.

BACKGROUND OF THE INVENTION

1. Field of the Invention

This invention relates to a device for pulling embedded objects such as fence posts and piles out of the earth.

2. Brief Description of the Prior Art

There are in the prior art a number of patents which purport to teach devices designed to remove objects from the ground. These patents deal primarily with the removal of tree stumps. U.S. Pat. No. 2,796,233 is such a patent. The apparatus of that patent must be towed to the stump which is to be pulled, released from the towing vehicle, placed in operating position and a wire sling must then be tied around the stump before any removal operation can be effected. Using such a device to remove fence posts, although effective, would be extremely inefficient. The device would have to be towed to each individual fence post, unhooked from the towing vehicle and placed in lifting position for each fence post.

Other stump pulling devices such as those disclosed in U.S. Pat. Nos. 1,258,691, 1,194,214, 2,025,340 and 1,151,270 would be even more inefficient and cumbersome to use in the extraction of fence posts than the device shown in U.S. Pat. No. 2,796,233.

Typically, fence posts are extracted by tying one end of the cable to a tractor or truck and the other end of the cable to the fence post and then placing the tractor or truck in gear exerting horizontal force on the fence post. Such an operation is usually performed by two people, one to drive the truck or tractor and one to tie the cable or chain to each fence post. It is often the case that the fence post is not easily removed by such a method. Further, the exertion of horizontal force has a tendency to shear the fence post off often at ground level. When this occurs, it is necessary to dig out the portion of fence post remaining in the ground. If that portion of fence post remaining in the ground is not removed, it is likely to interfere with the installation of a new fence post.

A variation of the preceding method of removing fence posts, includes the use of a winch. Depending on the orientation of the winch, it can be used to exert horizontal or more or less, vertical force on a fence post. Exerting horizontal force yields the identical problems of the preceding method. Exerting vertical force, although an improvement, still requires two people to operate efficiently. Otherwise, it would necessary for one person to drive the vehicle into position next to the fence post, exit the vehicle and attach the cable or chain to the fence post, re-enter the vehicle to operate the winch and extract the fence post, lower the fence post to the ground, exit the vehicle, remove the chain or cable from the fence post and re-enter the vehicle to begin the process all over again on the next fence post.

SUMMARY OF THE INVENTION

It is an object of the present invention to provide an apparatus by which a fence post can be efficiently removed in a one person operation.

Another object of the present invention is to provide an apparatus which mounts on a tractor or other piece of mobile equipment.

A further object of the present invention is to provide an apparatus which can be controlled by the existing hydraulic controls of the tractor or other vehicle.

Another object of the present invention is to provide an apparatus which automatically grasps a fence post and thereby making it unnecessary for the operator to exit the vehicle to connect the apparatus to the fence post.

A further object of the present invention is to provide an apparatus which allows the operator to automatically release the fence post after it has been extracted.

Another object of the present invention is to provide an apparatus which can be operated to remove fence posts one after another, in a continuous operation without the operator having to exit the vehicle.

Briefly stated, the foregoing and other objects and advantages of the present invention are accomplished by mounting a hydraulically actuated jib and lifting arm device to a mobile vehicle which contains its own hydraulic system such as a farm tractor or a backhoe. The hydraulic system of the vehicle is used in conjunction with the vehicles lifting bars to raise and lower the device.

The vehicles hydraulic system also actuates the hydraulic cylinder mounted to the device's main support structure. Located near the distal end of the main support structure is a jib mounted to a support sleeve which slides over the main support structure. Also attached to the support sleeve is a pivotally mounted lifting arm. There is a fixed length of cable attached on one end to the support sleeve and on the other end to the lifting arm and which travels through a series of sheaves mounted to the jib and support sleeve.

At the distal end of the lifting arm, there is a set of self clamping jaws which are automatically actuated when the lifting arm is pivoted upward. When the hydraulic cylinder is actuated, the support sleeve slides along the main support frame toward the vehicle. Due to the arrangement of sheaves, the length of cable between the lifting arm and the sheave located at the top of the jib, decreases dramatically thereby pivoting the lifting arm upward.

Simultaneous with the lifting of the lifting arm, the jaws clamp shut. In practice, the vehicle is backed up to the fence post or pile desired to be extracted thereby positioning the jaws about the fence post or pile. The hydraulic cylinder is actuated thereby clamping the jaws about the fence post or pile and pulling the fence post or pile out of the earth all in one motion. The fence post or pile is then dropped merely by lowering the lifting arm through the use of the hydraulic cylinder.

DESCRIPTION OF THE PREFERRED EMBODIMENT

Figures 1, 2, 3:
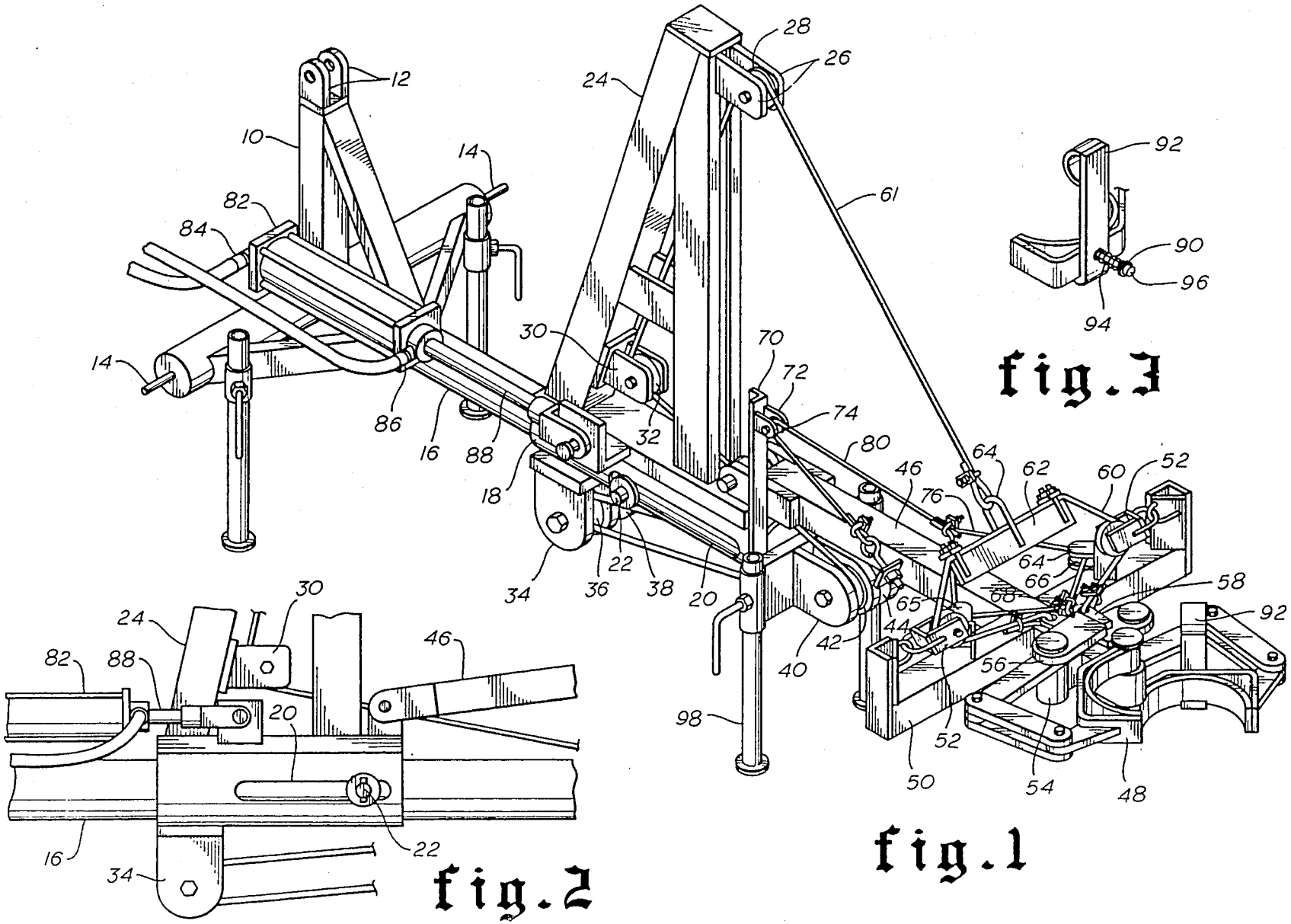
FIG. 1 is an isometric view of the apparatus.
FIG. 2 is a side elevation detail of the sleeve slidably mounted to the main support member.
FIG. 3 is an isometric detail drawing of the spring loaded clamping support structure.
Figure 4:
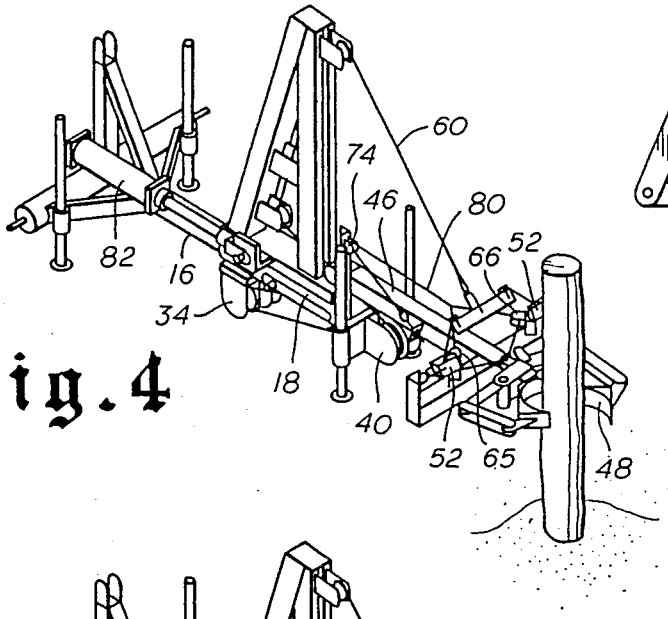
FIG. 4 is an isometric view of the apparatus placed in position to extract a fence post.
Figure 7:
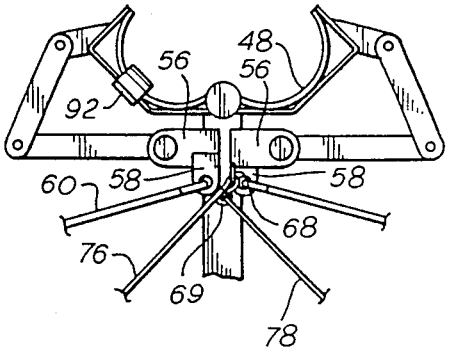
FIG. 7 is a plan view detail of the self-clamping jaws.
Figure 5:
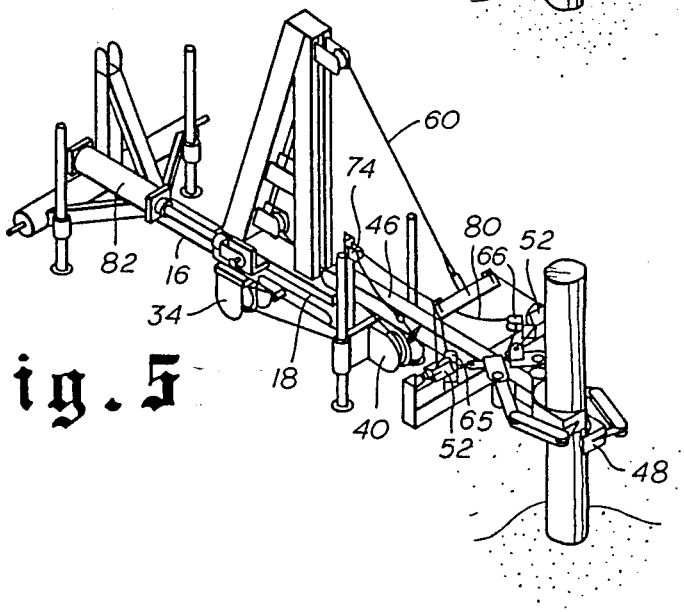
FIG. 5 is an isometric view of the apparatus in which the fence post has been engaged.
Figure 6:
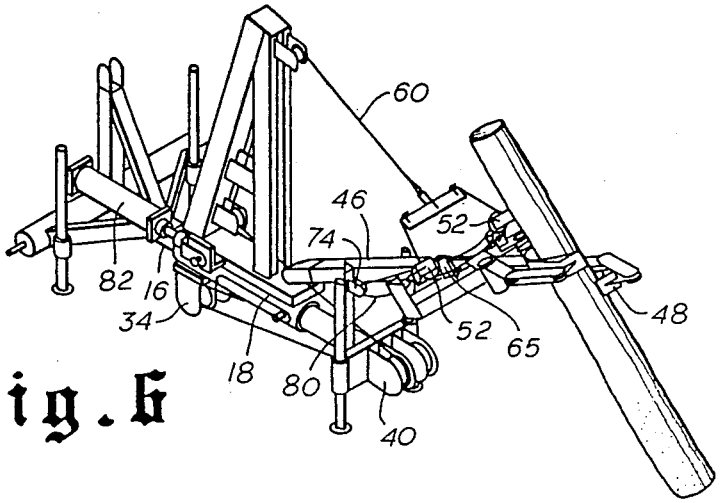
FIG. 6 is an isometric view of the apparatus extracting the fence post.

Referring now to the drawings, the hydraulic fence post puller is an apparatus adapted to be mounted on and used in conjunction with a farm tractor, back hoe or similar piece of mobile equipment having hydraulic controls.

FIG. 1 shows a T-support 10 particularly adapted to mount to the standard three point hitch of a tractor. There are bracket ears 12 mounted to the top of the vertical member of the T-support 10 adapted to be connected to the center link stabilizer of the three point hitch. There are cylindrical nipples 14 extending from the T-support which are adapted to connect to the lower lift links of the three point connection. Extending horizontally from the T-support 10 is the support shaft 16. Slidably mounted on the support shaft 16 is a support sleeve 18. Support sleeve 18 contains a pair of lateral slots 20. There is a pin 22 which inserts through support shaft 16 and extends on each end through the lateral slots 20 thereby preventing support sleeve 18 from rotating about support shaft 16. Sheave support structure 24 extends vertically from support sleeve 18. Sheave support frame 24 is basically in the form of a modified "A" frame and further functions as a jib.

Just below the apex of support frame 24 there extends forward angling below horizontal a pair of sheave brackets 26 supporting sheave 28. Near the base of the A extending horizontally forward from the inside face of A are sheave brackets 30 supporting sheave 32. Mounted to the underside of support sleeve 18 and extending vertically downward is double sheave bracket 34 containing sheaves 36 and 38. Mounted to the front of the support shaft 16 is double sheave bracket 40 containing sheaves 42 and 44. Double sheave bracket 40 extends at an angle slightly below horizontal to allow for clearance between it and lifting arm 46. There is a lifting arm 46 pivotally connected to the support sleeve 18 allowing the lifting arm 46 to be pivoted from approximately horizontal position to approximately vertical position.

At the distal end of the lifting arm 46 there is pivotally connected a set of self clamping jaws 48. The self clamping jaws 48, pivot horizontally in different planes one above the other. There is a cross support 50 connected to the lifting arm 46 extending horizontally and perpendicular to the lifting arm 46 in each direction. There are sheave supports 52 attached to each end of the cross support 50. There are pivot supports 54 extending horizontally from each side of the lifting arm 46 rotatably connected through the pivot supports 54 are pivot arms 56 having cable eyes 58. Pivot arms 56 are each double jointed and attached to their respective jaws 48. There is a fixed length of cable 60 attached at each end to a cable eye 58 and which feeds through sheaves 52. There is a lifting bar 62 to which the cable 60 is attached across the length of the lifting bar 62. Affixed to lifting bar 62 is lifting eye 64.

There is another fixed length of cable 61 tied to lifting eye 64 and which feeds through sheave 26, sheave 32, sheave 40, sheave 36, sheave 44 and sheave 38 and then is anchored to the base of double sheave bracket 40.

Attached to cross support 50 approximately midway between lifting arm 46 and the ends of the cross support 50 are sheave brackets 64 containing sheaves 66. There is a second set of cable eyes 68 and 69 affixed to pivot arms 56. Extending vertically upward from double sheave bracket 40 is support 70 which has mounted to it sheave bracket 72 containing sheave. There is a left cable 76 which attaches to right cable eye 68 and feeds through sheave 66. There is a right cable which attaches to left cable eye 69 and feeds through sheave 65. After the left cable 76 and the right cable 78 feed through their respective sheaves they tie together and also to cable 80. Cable 80 then feeds through sheave 74 and then attaches to lifting arm 46 near its midpoint.

Mounted to T-support 10 and support shaft 16 is hydraulic cylinder 82 having hydraulic hose connections 84 and 86. The hydraulic piston 88 of hydraulic cylinder 82 is pinned at its distal end to support sleeve 18. The invention is mounted on the three point connection of a tractor as earlier described. The hoses of hydraulic cylinder 82 are connected to the hydraulic system of the tractor. Through the use of hydraulic controls of the tractor, the hydraulic cylinder 82 can be used to push the support sleeve 18 along support shaft 16 away from hydraulic cylinder 82 or to pull support sleeve 18 along support shaft 16 toward hydraulic cylinder 82.

When the hydraulic cylinder 82 is used to pull the support sleeve 18 toward it, a distance between double sheave bracket 34 and double sheave bracket 40 increases thereby taking up much of the cable and thereby exerting upward force on the lifting arm 46. Simultaneously, cable 60 is drawn through sheaves 52 thereby causing the jaws 48 to close toward one another. Thus, the self-clamping action of the jaws and the lifting action of the arms are actuated by a single hydraulic control. As the lifting arm 46 elevates, cable 80 becomes slack thereby providing no tension to the opening mechanism of the jaws 48. When hydraulic cylnder 82 pushes sleeve 18 away thereby lowering the lifting arm 46 from it along support shaft 16, the slack in cable 80 is taken up by the increasing distance between sheave 74 and sheaves 65 and 66, thereby causing jaws 48 to open.

There is a bolt 90, the head of which is welded to the back of the lower jaw 48. The bolt 90 inserts through a hole in clamping support 92 which extends vertically upward from the back face of the lower jaw 48. There is a spring 94 which encircles the bolt 90 and which is held in place by a nut 96. This arrangement gives the upper jaw 48 a spring loaded clamping support 92 against which a fence post can be pushed by the upper jaw 48 and thereby prevents the snapping or extreme bending of the fence post by the jaws 48.

In practice, the invention once mounted to the tractor, is placed in position by backing the tractor up to the fence post so that the fence post is within the jaws 48. The tractor operator, through the use of the hydraulic controls of the tractor then raises the lifting arm 46 simultaneously closing the jaws 48. The fence post is thus clamped, lifted and removed all in one action. The fence post is then released by merely lowering the lifting arm 46. The tractor can then be driven to the next post and so on.

The invention has four adjustable support legs 98 which support the apparatus when it is not connected to a tractor. This adjustable support leg 98 arrangement allows the apparatus to be stored in a stable position at an elevation convenient for hooking up the apparatus to a tractor.

From the foregoing, it will be seen that this invention is one well adapted to attain all of the ends and objects hereinabove setforth, together with other advantages which are obvious and which are inherent to the apparatus.

As many possible embodiments may be made of the invention without departing from the scope thereof, it is to be understood that all matter herein setforth or shown in the accompanying drawings is to be interpreted as illustrative and not in a limiting sense.

What is claimed is:

1. An apparatus for extracting fence posts and the like from the earth comprising:

(a) a main support member having proximal and distal ends;

(b) means for connecting said proximal end of said main support member to a tractor, back hoe or other piece of mobile equipment so that said apparatus is placed in position for fence post extraction and operated while connected to the tractor, backhoe or other piece of mobile equipment;

(c) lifting means mounted to said main support member for exerting substantially vertical upward force on the fence post;

(d) an active engaging means affixed to said lifting means for affirmatively gripping fence posts of substantially differing diameters automatically when said lifting means is actuated so that each fence post is engaged and removed in one action;

(e) a hydraulic piston means to supply the extractive force required by said lifting means;

(f) a cable and sheave arrangement means for increasing the vertical travel of said lifting means such that the vertical travel of said lifting means is greater than the actual travel of said hydraulic piston means.

2. An apparatus as recited in claim 1 wherein: said hydraulic piston means is hydraulically connected to and controlled by the existing hydraulic control system of the tractor, backhoe or other piece of mobil equipment.

3. An apparatus as recited in claim 1 wherein: said means for connecting said proximal end of said main support member to the tractor is the standard three point hitch of the tractor.

4. An apparatus as recited in claim 1 wherein:

(a) said lifting means is comprised of a sleeve slidably mounted on said main support member;

(b) a jib connected to said sleeve projecting substantially vertically upward from said sleeve;

(c) a lifting arm pivotally connected at a proximal end to said sleeve so that said lifting arm may rotate from substantially horizontal position to substantially vertical position;

(d) a hydraulic cylinder controlling the travel of said sleeve along said main support structure;

(e) a plurality of sheaves mounted to said jib and said sleeve;

(f) a fixed length of cable attached at a first end to a distal end of said lifting arm and attached at a second end to said distal end of said main support member so that as said hydraulic cylinder pulls said sleeve, the distance between the sheaves mounted to said sleeve and said sheaves mounted to said jib, increases thereby taking up said cable and causing said lifting arm to pivot vertically.

5. An apparatus for extracting fence posts and the like out of the earth adapted to be used in conjunction with a tractor, backhoe or other piece of mobile equipment comprising:

a. a main support member having proximal and distal ends;

b. means for connecting said proximal end of said main support member to the tractor;

c. lifting means mounted to said main support member engageable to a fence post or the like for exerting substantially vertical upward force on the fence post; and d. engaging means for automatically encircling and gripping the fence post when said lifting means is actuated, said engaging means extending from said lifting means.

6. In combination with a tractor, backhoe or other piece of mobile equipment having a hydraulic control system for operating devices connected to the tractor, backhoe or other piece of mobile equipment, an apparatus for extracting fence posts and the like for the earth comprising:

a. a main support member having proximal and distal ends;

b. means for connecting said proximal end of said main support member to the tractor;

c. lifting means mounted to said main support member for exerting substantially vertical upward force on the fence post;

d. an active engaging means affixed to said lifting means for affirmatively gripping fence posts of substantially differing diameters automatically when said lifting means is actuated so that each fence post is engaged and removed in one action, said active engaging means being able to affirmatively grip fence posts which reside in substantially vertical position or in positions of substantial variance to the vertical.

7. An apparatus for extracting fence posts and the like from the earth comprising:

a. a main support member having proximal and distal ends;

b. means for connecting said proximal end of said main support member to a tractor, backhoe or other piece of mobile equipment so that said apparatus is placed in position for fence post extraction and operated while connected to the tractor, backhoe or other piece of mobile equipment;

c. lifting means mounted to said main support member for exerting substantially vertically upward force on the fence post;

d. engaging means extending from said lifting means for automatically encircling and affirmatively gripping the fence post when said lifting means is actuated after the tractor, backhoe or other piece of mobile equipment has been manuevered to place said engaging means in close proximity to the fence post so that when said lifting means is actuated each fence post is engaged and removed in one action.

8. An apparatus for extracting fence posts and the like from the earth comprising:

(a) a main support member;

(b) a sheave support frame slidably mounted to said main support member;

(c) lifting means pivotally mounted to sheave support frame;

(d) hydraulic piston means for driving said sheave support frame along said main support member;

(e) a plurality of sheaves mounted to said sheave support frame;

(f) engaging means for automatically encircling and gripping the fence post when said lifting means is actuated, said engaging means extending from said lifting means;

(g) a fixed length of cable attached at a first end to said lifting means and at a second end to said sheave support frame, said fixed length of cable being deployed through said plurality of sheaves so that when said hydraulic piston mean drives said sheave support frame, the vertical travel imparted to said lifting means is greater than the travel of said hydraulic piston means.

* * * * *